US006276688B1

(12) United States Patent
Ullerich et al.

(10) Patent No.: US 6,276,688 B1
(45) Date of Patent: Aug. 21, 2001

(54) PORTABLE PARLOR GAME

(75) Inventors: Ingo Ullerich; Oliver Hehemann, both of Cologne (DE)

(73) Assignee: Franz Josef Paus (DE)

( * ) Notice: Subject to any disclaimer, the term of this patent is extended or adjusted under 35 U.S.C. 154(b) by 0 days.

(21) Appl. No.: 09/308,999

(22) PCT Filed: Nov. 27, 1997

(86) PCT No.: PCT/EP97/06624

§ 371 Date: Jun. 1, 1999

§ 102(e) Date: Jun. 1, 1999

(87) PCT Pub. No.: WO98/23343

PCT Pub. Date: Jun. 4, 1998

(30) Foreign Application Priority Data

Nov. 29, 1996 (DE) ..... 296 20 807 U

(51) Int. Cl.[7] ..... A63F 3/00

(52) U.S. Cl. ..... 273/287; 273/236; 273/241

(58) Field of Search ..... 273/236, 239, 273/287, 241; D21/334, 336, 338, 341, 342, 343

(56) References Cited

U.S. PATENT DOCUMENTS 5,197,742 * 3/1993 Bendit .

FOREIGN PATENT DOCUMENTS

3816338A1 * 11/1989 (DE) .
60791 * 10/1955 (FR) .

* cited by examiner

*Primary Examiner*—Benjamin H. Layno
*Assistant Examiner*—Vishu K. Mendiratta
(74) *Attorney, Agent, or Firm*—Diller, Ramik & Wight

(57) ABSTRACT

Portable parlor game (10) comprising a central dice area (17), an upward extending side wall (20) surrounding the dice area (17) and a game course (16) for game figures (15) with the game course (16) surrounding the dice area (17) and being adjacent to the upper end of the side wall (20). The upward extending side wall (20) is essentially outward inclined so that the dice (31) hitting the side wall (20) is rebounced slighty upwards and the dice first describes a short trajectory after hitting the side wall (20) and is not immediately decelerated.

8 Claims, 3 Drawing Sheets

PORTABLE PARLOR GAME

BACKGROUND OF THE INVENTION

The invention relates to a parlor game where game pieces and figures are moved on a game course and a dice is used.

Known parlor games are frequently so-called board games where the game course is applied onto a plane board surface. The dices are thrown beside or on the board. However, the dice may unintentionally be thrown in such a way that it collides with the figures and displaces them or knocks them down.

SUMMARY OF THE INVENTION

It is the object of the invention to create an improved parlor game comprising a central dice area surrounded by a side wall.

The parlor game according to the invention comprises in the middle a dice area surrounded by a side wall with the game course being adjacent to the upper end of the side wall thus surrounding the dice area so that the dice always rebounces from the side wall and rolls back onto the dice area. It is not possible that the dice knocks down the figures on the game course. The side wall is essentially outward inclined, i. e. away from the dice area. Owing to this inclination the dice hitting the side wall rebounces upwards from the side wall, i. e. at an angle of more than 0° relative to the horizontal. The dice is in the air after rebouncing so that the angular momentum of the rebouncing dice is not reversed first. Due to this fact the dice is not decelerated immediately after rebouncing.

The dice describes a short trajectory prior to its falling back onto the dice area where it is decelerated owing to reversal of the angular momentum. Thus the throwing path and the throwing time are increased when the dice is thrown so that the dice describes more rotations, is less manipulable and describes a more appealing throwing pattern.

Due to the inclination of the side wall the pictures, information, notices, advertisements etc. fixed thereon are clearly visible and better noticeable from every direction of sight.

In a preferred embodiment the inclination angle of the side wall relative to the vertical of the dice area is at least 5° to achieve sufficient lifting of the dice after rebouncing from the side wall.

Preferably a lower strip portion of the side wall is vertical or inclined inwards towards the dice area with the height of the strip being less than half the side wall height. The contact line between the upper outward inclined side wall strip and the lower vertical or inwards inclined side wall strip forms a peripheral edge whose height is less than half the side wall height. Furthermore the height of this edge should be less than half the edge length of the dice used. This ensures that the dice always rebounces from the side wall in upward direction.

In a preferred embodiment a box for playing material, game pieces and figures is provided, which can be placed into the deepened portion formed by the side wall and the dice area without the box projecting beyond the side wall. This offers a compact and practical solution for orderly stowage of the playing material. The box may be executed as a rectangular box with compartments, which can be placed into the—if desired—rectangular deepened portion formed by the side wall and the dice area in such a way that it is retained by the side wall within the dice area with only little play.

Preferably metal strips are arranged below the game course so that game pieces or figures comprising magnetic elements are retained on the game course. The metal strips are covered by paper or plastic game course foil onto which a playing plan is printed. The game pieces comprising magnets are thus well retained on the game course so that the game pieces and figures cannot be displaced by unintentional touch or vibration.

In a preferred embodiment information boards can be attached to the inclined side wall by means of fasteners. Adhesive strips on the back of the information boards, which may contain advertisements, rules of the game or other motives, may serve as fasteners.

Preferably the dice area, the side wall and the game course are permanently arranged in a case shell capable of being closed by a lid. After removal of the lid and possibly the box for the playing material, the game can immediately be started. It is not necessary to set up the game.

Hereunder two embodiments of the invention are explained in detail with reference to the drawings in which

DESCRIPTION OF THE PREFERRED EMBODIMENTS

Figure 2:
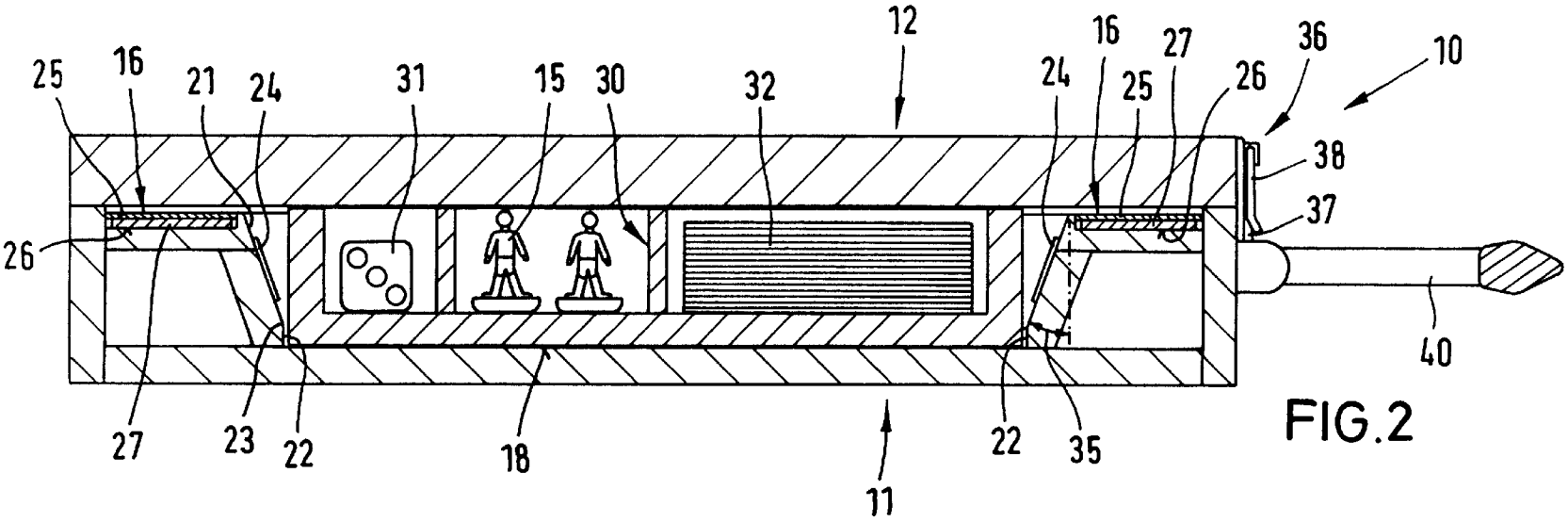
FIG. 2 shows a longitudinal section along line II—II of the parlor game shown in FIG. 1 comprising an inserted playing material box and a closed lid.

In the Figs. a game case. 10, 10' is shown as a portable parlor game, which comprises a case shell 11, 11' and a lid 12 (FIG. 2). In the parlor game the figures 15 are placed onto a peripheral closed game course 16, 16' and the development of the game is determined, inter alia, by throwing the dice.

Figure 1:
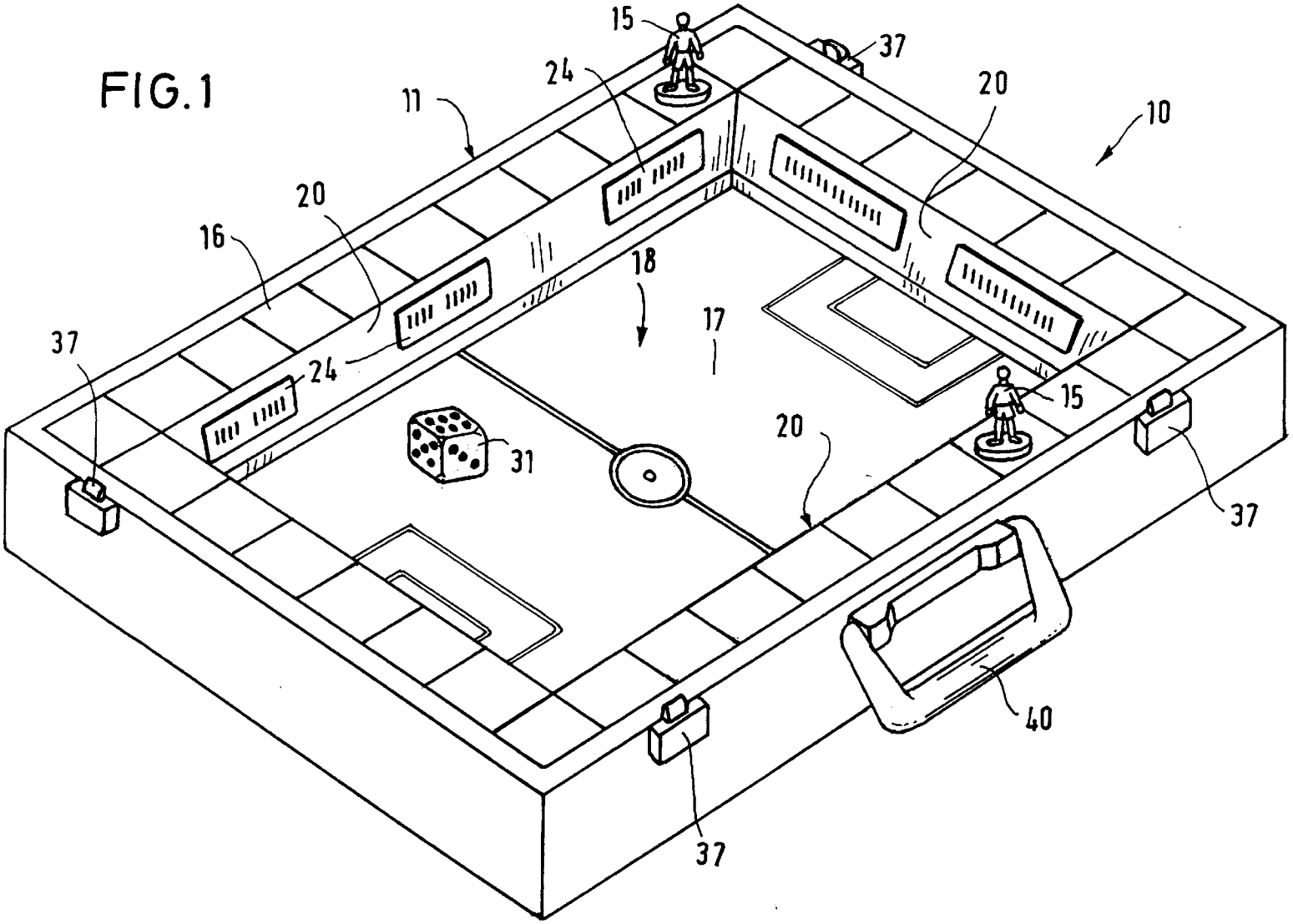
FIG. 1 shows a perspective view of a first embodiment of the parlor game.
Figure 3:
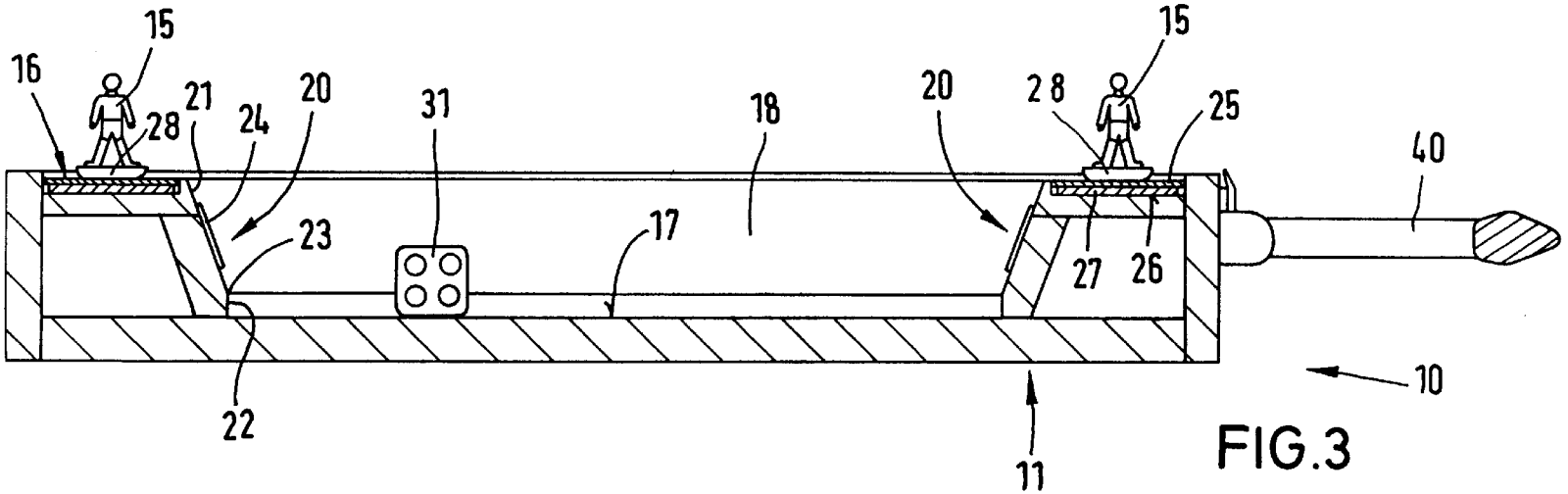
FIG. 3 shows a longitudinal section of the parlor game shown in FIG. 1 along line II—II.
Figure 4:
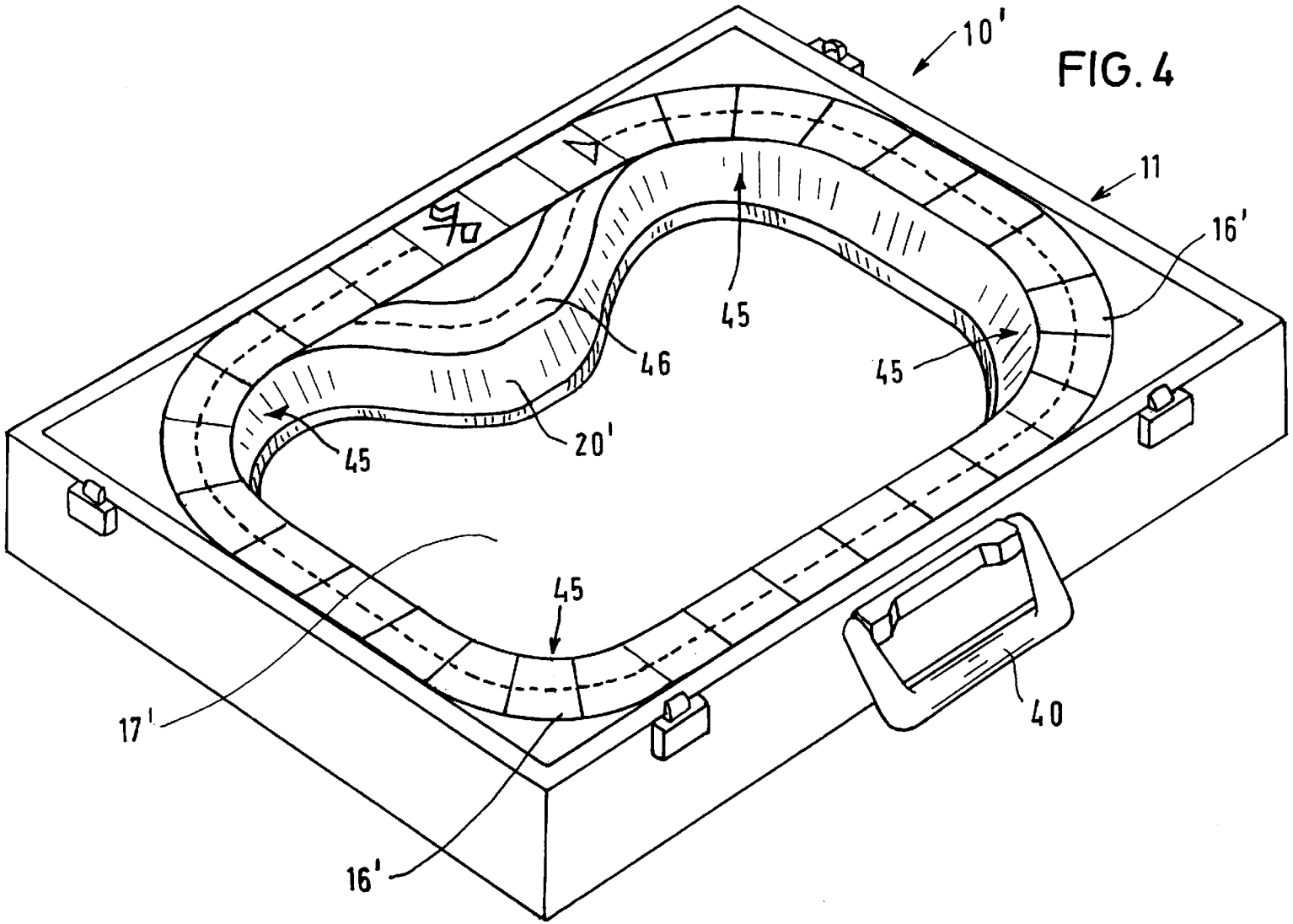
FIG. 4 shows a perspective view of a second embodiment of the parlor game.

In the game case 10 shown in FIGS. 1–3 the rectangular peripheral game course 16 surrounds an also rectangular dice area 17 which is formed by the floor of a deepened portion 18 in the middle of the case shell 11. The edges of the deepened portion 18 are formed by the side walls 20 whose upper section 21 is inclined towards the case edge. The inclination angle 35 of the upper section 21 of the side wall 20 is approximately 20°. The lower strip-type section 22 of the side wall 20 is arranged vertically. The height of the lower strip section 22 is 10 mm, the height of the upper section 21 is 30 mm. The difference in height between the game course 16 and the dice area 17 thus amounts to 40 mm. The contact line of the upper side wall area 21 and the lower side wall area 22 forms a horizontal edge 23 as shown in FIGS. 2 and 3.

The game course 16 is formed by a plastic foil 25 covering plates 27 of magnetic metal lying in a flat deepened portion 26.

The case shell 11 comprises a plastic injection moulding part into which a moulded plastic insert is placed which forms the game course 16, the side walls 20 and the dice area 17. The case shell and the insert may however also be made of other materials, such as wood, cardboard etc.

As shown in FIG. 2, a box 30 open to the top and comprising several compartments for playing material, the figures 15, dices 31, playing cards 32 is arranged in the deepened portion 18. The box 30 thus serves for orderly stowing and making available the playing material.

The case shell 11 is closed by a plate-type lid 12 fixed to the outer sides of the case shell walls by means of four case locks 36 each comprising a folding part 38 and a fixed part 37 (FIG. 2). At the front side of the case shell 11 a case handle 40 for carrying the case 10 is provided.

In the upper section 21 of the side walls 20 information boards 24 are applied by means of adhesive as fastener. The information boards 24 may for example be used as advertising fields. Due to the inclined arrangement of the upper section 21 of the side wall 20, the information boards 24 are clearly visible from all sides.

The flooring of the dice area 17 is made of soft felt which allows low-noise throwing of the dice. Onto the flooring of the dice area 17 firm's logos, advertisements or the playing field markings of the respective sport can be printed.

The figures 15 comprise magnets 28 in their foot or floor areas so that the figure 15 is retained by the attractive forces between the magnet 28 of the figure 15 and the plates 27 of the game course 16 on the game course 16 even in the case of slight vibrations, inclined position etc., in particular when vibrations are caused by throwing the dice.

The rectangular configuration of the dice area 17 and the game course 16 is for example suitable for games imitating football, tennis and other sports. The dice area and the game course may however also have a different form.

To set up the parlor game first the folding parts 38 of the case locks 36 are opened and the lid 22 is removed from the case shell 11. Then the playing material box 30 is taken out of the deepened portion 18 serving as dice area and the figure 15 are placed onto the game course 16. Further setup of the game is not necessary so that the game can be started at once. For throwing the dice the dice/dices 31 is/are thrown or rolled onto the dice area 17. When the dice 31 is rolled, it has an angular momentum corresponding to its rolling speed and bounces in this condition onto the side wall 20. Due to the slightly inclined upper section 21 of the side wall 20 the dice 31 is rebounced at an angle corresponding to approximately twice the inclination angle of the upper section 21 relative to the dice area 17. When the dice 31 has hit the side wall 20, it describes a trajectory prior to its hitting the dice area 17 again. Only when the dice 31 hits the dice area 17 the angular momentum of the dice 31 is reversed so that it loses part of its kinetic energy. Owing to the inclined position of the side wall 20, this point of reversal is delayed. Thus the distance covered by the dice is increased and throwing of the dice is made easier.

In a second embodiment of the game case 10' the arrangement and the form of the game course 16' are modified. The four corner areas 45 of the dice area 17' formed by the side walls 20' are not angular but round. Furthermore, a nose-shaped protuberance 46 is provided in the central area of a longitudinal side of the game course 16', which enlarges the game course 16' at this location. For example, a passage for pit stops can be provided here in a game imitating a motor race.

The external dimensions of the case shell 11 including the lid 12 are approximately 46×35×7 cm. The depth of the deepened portion 18 is 4 cm. The dice 31 has an edge length of 20 mm. The dice area is approximately 33×22 cm large.

Although a preferred embodiment of the invention has been specifically illustrated and described herein, it is to be understood that minor variations may be made in the apparatus without departing from the spirit and scope of the invention, as defined the appended claims.

We claim:

1. A portable parlor game comprising a central dice area (17, 17'), an upward extending side wall (20, 20') surrounding the dice area (17, 17'), a closed and recess-free game course (16, 16') for moving game pieces or figures (15) therealong which surrounds the dice area (17, 17) and is adjacent to the upper end of the side wall (20, 20'), and the upward extending side wall (20, 20') is substantially inclined outwards.

2. The portable parlor game according to claim 1, characterized in that the inclination angle (a) of the side wall (20, 20') relative to the vertical of the dice area (17, 17') is at least 5°.

3. The portable parlor game according to claim 2, characterized in that a lower section (22) of the side wall (20, 20') is substantially vertical, and the height of the lower section (22) is less than half the side wall height.

4. The portable parlor game according to claim 1, characterized in that a lower section (22) of the side wall (20, 20') is substantially vertical, and the height of the lower section (22) is less than half the side wall height.

5. The portable parlor game according to claim 1, characterized in that strips of magnetic material are arranged below the game course (16, 16') so that game pieces or figures (15) comprising magnetic elements (28) are retained on the game course (16, 16').

6. The portable parlor game according to claim 1, characterized in that a box (30) for playing material, the game pieces and figures (15) is provided which can be placed into a deepened portion (18) formed by the side wall (20, 20') and the dice area (17, 17') without projecting beyond said deepened portion.

7. The portable parlor game according to claim 1, characterized in that information boards (24) can be fixed to the inclined side wall (20, 20') by means of fasteners.

8. The portable parlor game according to claim 1, characterized in that the dice area (17, 17'), the side wall (20, 20') and the game course (16, 16') are permanently arranged in a case shell (11) comprising a lid (12).

* * * * *